US005349724A

United States Patent [19]

Bracco Barcina et al.

[11] Patent Number: 5,349,724

[45] Date of Patent: Sep. 27, 1994

[54] HERMETIC SEAL FOR LIQUID CONTAINERS

[76] Inventors: Mario Bracco Barcina, Villarroel St. 253; Enrique Miro Domenech, c/o Mario Bracco, Villarroel 253, both of, 08036 Barcelona, Spain

[21] Appl. No.: 978,636

[22] Filed: Nov. 19, 1992

[30] Foreign Application Priority Data

Nov. 20, 1991 [ES] Spain ..... P 9102573
Nov. 12, 1992 [ES] Spain ..... P 9202278

[51] Int. Cl.[5] ..... B65D 77/18
[52] U.S. Cl. ..... 24/30.5 R; 24/537
[58] Field of Search ..... 24/30.5 R, 503, 515, 24/537

[56] References Cited

U.S. PATENT DOCUMENTS

| | | | |
|---|---|---|---|
| 718,794 | 1/1903 | Reimard | 24/537 |
| 1,634,532 | 7/1927 | Bowe | 24/503 |
| 2,228,360 | 1/1941 | Nordeck | 24/503 |
| 4,238,865 | 12/1980 | Ingemann et al. | 24/537 X |
| 4,648,160 | 3/1987 | Spinosa et al. | 24/30.5 R X |
| 4,669,152 | 6/1987 | Alexander | 25/30.5 R |

FOREIGN PATENT DOCUMENTS

| | | | |
|---|---|---|---|
| 123444 | 1/1947 | United Kingdom | 24/537 |
| 1596746 | 8/1981 | United Kingdom | 24/537 |

*Primary Examiner*—James R. Brittain
*Attorney, Agent, or Firm*—McGlew and Tuttle

[57] ABSTRACT

The device which forms the object of the present invention comprises flat element (1) more than half of which is subdivided longitudinally into two parts (2 and 3). The external faces of the element (1) are provided with longitudinal grooves (4) and the internal faces are provided with longitudinal parallel ribs (5). The element (1) is embraced by a bridge piece (6) with laterally projecting wings (7) and a number of inner ribs (8) which slide within the grooves (4). To seal the opening of the container the lips of the opening are simply fitted between the two parts (2 and 3). Once in this position, the bridge piece (6) is simply pushed along by pressing the projections (7) with the fingers such that as it advances, guided by the coupling which exists between the ribs (8) and the grooves (4), it applies pressure on the opening until it is perfectly sealed, the presence of the ribs (5) eliminating any tendency of the new seal to slip.

5 Claims, 2 Drawing Sheets

HERMETIC SEAL FOR LIQUID CONTAINERS

FIELD OF THE INVENTION

The present invention relates to a hermetic seal for liquid containers, in particular for "tetrapak" type containers which otherwise remain permanently open once one of the corners has been cut.

BACKGROUND OF THE INVENTION

In recent years the industry of containers for domestic liquids, such as milk, wine, water, fruit juices etc., has undergone significant developments, allowing it to move on from the traditional glass bottle to other types of container.

Among these, the one which appears to have received greatest acceptance is the polyhedral, generally prismatic container made of a sandwich of cardboard or other materials and known by the name "tetrapak".

This container has a number of advantages in terms of both containing the liquid and transporting it, as well as its resistance to breakage. One inconvenience, and perhaps the only one, is the fact that once the container has been opened by cutting one of its vertices it is not possible to close it again. For this reason the liquid it contains remains in permanent contact with the outside until it has been completely consumed.

This causes problems in the case of some of the liquids contained such as fruit juices which are oxidised by contact with the air and lose their properties.

There is also the danger of spillage of the contents due to the fact that the container is always open, meaning that it is better that the liquid be consumed as soon as possible.

SUMMARY AND OBJECT OF THE INVENTION

The object of the present invention is to eliminate all of the aforementioned problems by means of a device which, when fitted onto the cut vertex of the container, ensures that it is totally hermetically sealed, eliminating all of the problems mentioned above.

As a result of the device being claimed it is therefore even possible to apply this type of container to other liquids such as those which contain gas or alcohol and which would otherwise lose their properties upon contact with the air.

Furthermore, it is worth pointing out other advantages which the device disclosed gives to said containers:

There is no spillage of the liquid whilst it is open.

The container can be re-used, even to contain other products once the liquid originally contained has been consumed.

The container can be placed in any position.

It is possible to make containers such as those described which are even greater in size than the ones currently used.

The containers can be handled without difficulty since there is no danger of spillage.

Hygiene is improved since all contact between the liquid and the outside is eliminated.

Furthermore, the device is constructed such that it is never in contact with the liquid, and can be used regardless of how the container has been cut open.

Finally, it is even possible to produce an appreciable vacuum inside the container before it is hermetically sealed simply by pressing gently on the container.

In order to achieve all of the above, the hermetic seal for liquid containers which is being claimed comprises a flat, rectangular, parallelepiped-shaped element divided into two by a mid-plane over more than half its major axis, the outer faces of said element being provided with a number of longitudinal recesses along which slides another piece, in the form of a bridge, guided by said recesses, embracing said two faces and one of the edges of said element, such that once the lips of the opening of the container have been placed between the two parts of the parallelepiped, the bridge piece is simply advanced in order to seal said opening.

The seal is fixed in position more firmly by the presence of a number of longitudinal retention ribs on the internal faces of said two parts.

In order that the sealing device has a functional design both in terms of its manufacture and particularly its ease of use whilst achieving a perfect seal, the flat element is made in the form of a strip folded articulately about the mid-region where a number of projections are provided to act as stops for the rear part of the bridge piece, stabilising it in the end position from which it can be slid manually along the flat element to seal the opening of the container.

The free ends of each of the two parts of the flat element have concave edges which are pressed by the thumb during the manual sliding action of the bridge piece, the wings of which are pushed by the index and middle fingers, and one of the two parts being somewhat shorter than the other so that the thumb in not pinched as the two parts are forced together by the action of the bridge piece.

These and other characteristics will become more apparent from the detailed description which follows, together with a series of drawings which represent two practical embodiments purely as non-limiting examples of the scope of the invention.

DETAILED DESCRIPTION OF THE PREFERRED EMBODIMENT

Figure 1:
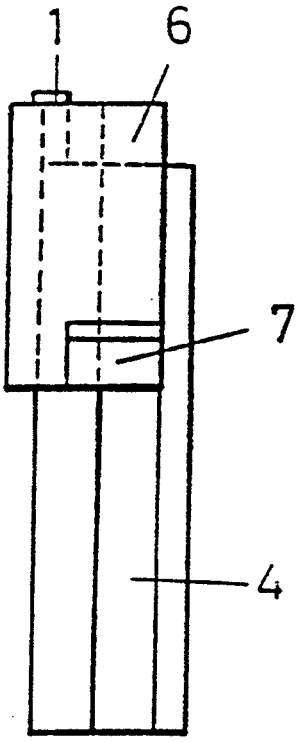
FIGS. 1 and 2 each represent elevation views in profile of the new hermetic seal for liquid containers which is being claimed.
Figure 2:
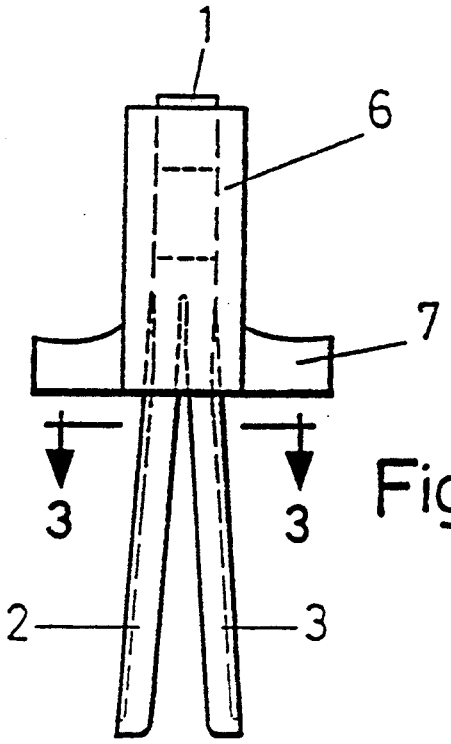
Figure 3:
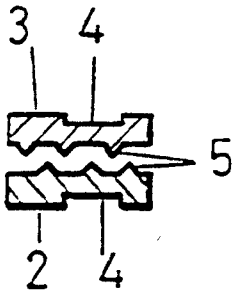
FIG. 3 is a detail of the sealing element in section taken across the line 3—3 of FIG. 2.
Figure 4:
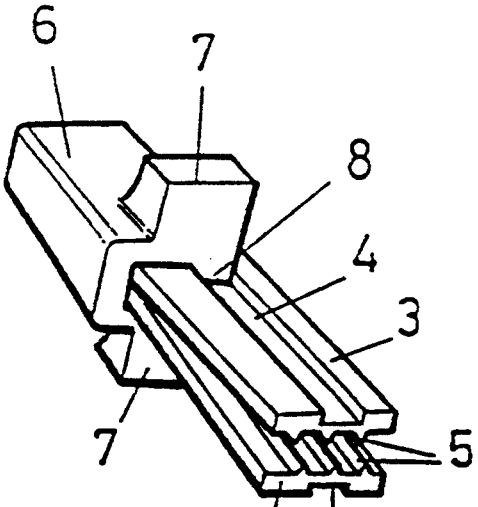
FIG. 4 shows a perspective view of the device claimed.
Figure 5:
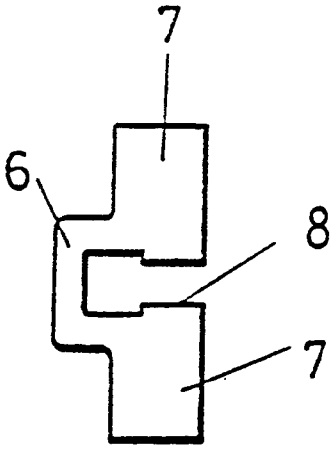
FIG. 5 represents a plan view of the bridge piece.

As can be appreciated from the drawings, the device consists of flat, rectangular parallelepiped-shaped element 1, more than half of which is subdivided into two parts 2 and 3 by a mid-plane running along its major axis.

The external faces of the element 1 are provided with longitudinal grooves 4 and the internal faces with longitudinal parallel ribs.

Embracing the element 1 is a bridge piece 6 with laterally projecting wings 7 and a number of inner ribs 8 which slide within the grooves 4.

To seal the opening A of the container E, the lips of said opening are simply fitted between parts 2 and 3. Once in this position, the bridge piece 6 is simply pushed along manually by means of the projections 7 which are pressed by the fingers such that as it advances, guided by the coupling which exists between the ribs 8 and the grooves 4, it applies pressure on the opening until it is perfectly sealed, the presence of the ribs 5 eliminating any tendency to slip and helping the seal.

Figure 6:
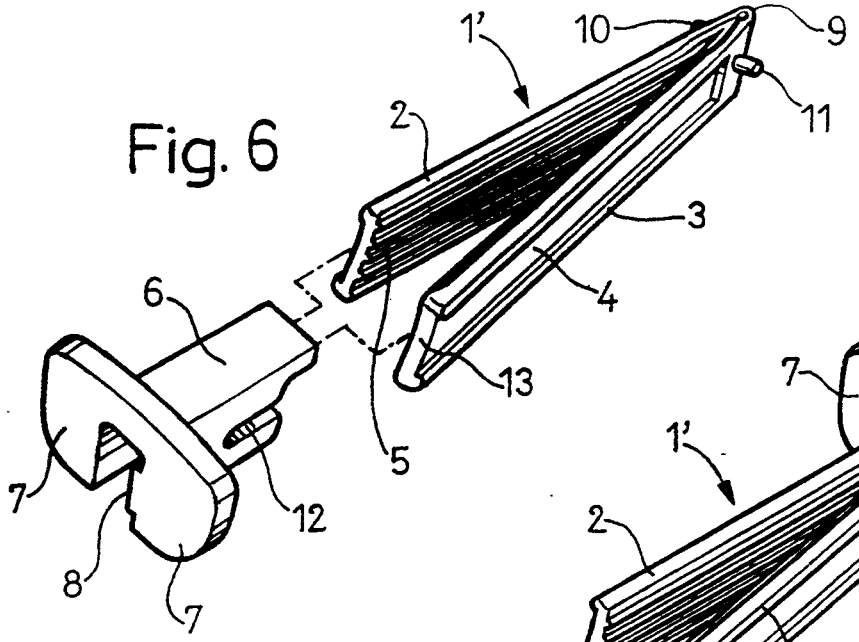
FIGS. 6 and 7 illustrate a perspective view of the flat element and the bridge piece assembled and disassembled respectively according to a second embodiment.
Figure 7:
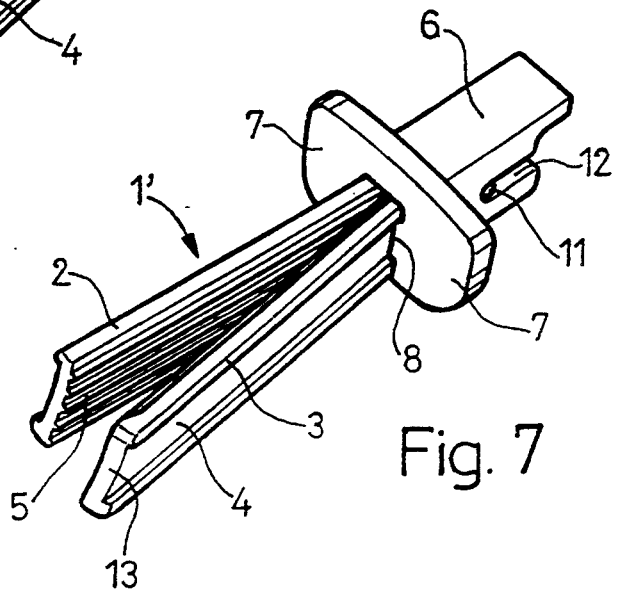

According to FIGS. 6 and 7 the flat element consists of a strip 1' of plastic provided with a transverse mid-region 9 which is weakened to act as a hinge, thereby enabling the strip to be folded articulately into a kind peg which forms parts 2 and 3.

Close to said mid-region and on either side thereof, the strip is provided with projections 10 and 11 which, when the bridge piece 6 is coupled thereto, act as stops for the rear part of said bridge piece, each one fitting into mortises 12 therein and stabilising the bridge piece (FIG. 7) in the position from which it can be slid manually along the flat element to seal the opening A of the "tetrapak" or "tetrabrik" container E.

Figure 9:
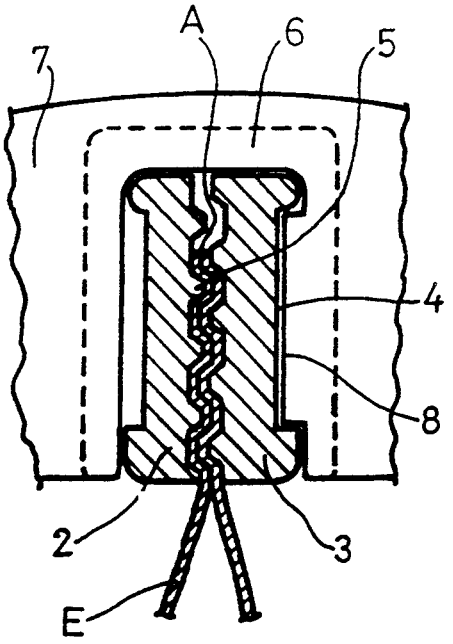
FIG. 9 shows a cross-sectional view of a detail of the seal fitted to the opening of a container.

The inner faces of the two parts 3 and 4 of said strip are provided with a number of longitudinal rib 5, those on one of the parts corresponding to the groove formed between two ribs on the other. This helps to seal the opening A of the container by creating a kind of tongue and groove joint as shown in FIG. 9.

Figure 8:
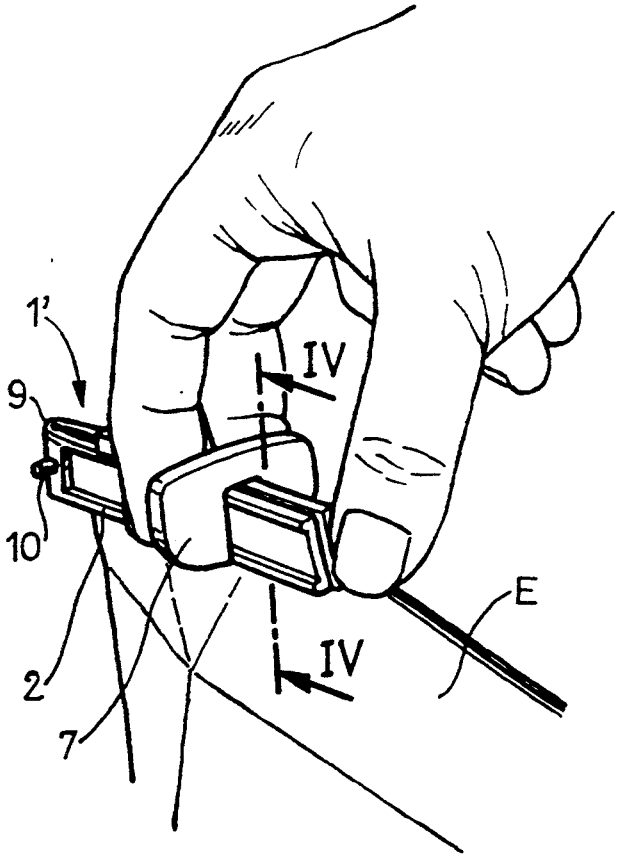
FIG. 8 shows in perspective how the container is sealed.

The bridge piece 6 has lateral wings 7 which make it easy to press with the index and middle fingers of one hand. In this way, by pressing the far end of strip 1' with the thumb, the opening of the container can be sealed with only one hand (FIG. 8).

In order that the thumb can press perfectly, the free ends of parts 2 and 3 are provided with concave edges 13, one of the two parts, part 2, being somewhat shorter than the other so that the thumb is not pinched as the two parts are forced together by the action of the bridge piece 6.

The eternal part of one or both of parts 2 and 3 may be provided with a projection near to the free end to prevent the bridge piece 6 from accidentally coming off during the sealing operation, although the bridge may clear said projection by pressing lightly thereon in order to completely open the two parts 2 and 3 when their internal faces have to be cleaned thoroughly.

What is claimed is:

1. A hermetic seal for liquid containers, comprising:

a flat, rectangular, parallelepiped-shaped element including a hinged mid-plane dividing said element into a first part and a second part over more than one half of a major dimension of said element, said element first part and said second part each having outer faces, each outer face having a longitudinal groove, and each of said first part of said second part having an inner face with longitudinally extending projecting ribs;

a bridge-shaped piece including first and second laterally projecting wings on each side of said peripheral opening, said bridge-shaped element defining a receiving portion between said wings, said receiving portion having an inner surface with inner surface ribs, said inner surface ribs being dimensioned corresponding to said longitudinal grooves for receiving said longitudinal grooves allowing said bridge receiving portion to receive said first part and said second part causing said longitudinal projecting ribs of said first part to move toward said second part in a region adjacent to said longitudinal ribs of said second part as said flat element is moved in sliding action into said receiving part.

2. A hermetic seal for liquid containers according to claim 1, wherein each of said first part and said second part have a free end with a concave edge for pressing said free end with a thumb during said sliding action between said bridge piece and said first part and said second part, one of said first part and said second part being shorter than another of said first part and said second part whereby the thumb is not pinched when said first part and said second part are forced together by said bridge.

3. A hermetic seal for liquid containers according to claim 1, wherein said flat element includes projections extending outwardly from said first part and said second part with a location adjacent to said mid-region, said bridge-shaped piece having a surface for engaging said projections forming a stop to maintain said flat element in said bridge receiving part.

4. A hermetic seal for liquid containers, comprising:

a flat, rectangular, parallelepiped-shaped element including a hinged mid-plane dividing said element into a first part and a second part over more than one half of a major dimensions of said element, said element first part and said second part each having outer faces, each outer face having a longitudinal groove, and each of said first part of said second part having an inner face with longitudinally extending projecting ribs, said longitudinal projecting ribs on said first part being offset from said longitudinal projecting ribs on said second part;

a bridge-shaped piece including first and second laterally projecting wings, said bridge-shaped element defining a receiving portion between said wings on each side of a peripheral opening, said receiving portion having an inner surface with inner surface ribs, said inner surface ribs being dimensioned corresponding to said longitudinal grooves for receiving said longitudinal grooves allowing said bridge receiving portion to receive said first part and said second part causing said longitudinal projecting ribs of said first part to move into a space between adjacent said longitudinal ribs of said second part or to move into a space adjacent an end of one of said longitudinal ribs of said second part as said flat element is moved in a sliding action.

5. A hermetic seal for liquid containers, comprising:

a flat, rectangular, parallelepiped-shaped element including a hinged mid-plane dividing said element into a first part and a second part over more than one half of a major dimension of said element, said element first part and said second part each having outer faces, each outer face having a longitudinal groove, and each of said first part of said second part having an inner face with longitudinally extending projecting ribs;

a bridge-shaped piece including first and second laterally projecting wings, said bridge-shaped element defining a receiving portion between said wings, said receiving portion having an inner surface with inner surface ribs, said inner surface ribs being dimensioned corresponding to said longitudinal grooves for receiving said longitudinal grooves allowing said bridge receiving portion to receive said first part and said second part;

said first part and said second part having a free end with a concave edge for pressing said free end with a thumb during said sliding action between said bridge piece and said first part and said second part, one of said first part and said second part being shorter than another of said first part and said second part whereby the thumb is not pinched when said first part and said second part are forced together by said bridge.

* * * * *